US008550146B2

(12) United States Patent
Mizukusa et al.

(10) Patent No.: US 8,550,146 B2
(45) Date of Patent: Oct. 8, 2013

(54) VALVE DEVICE FOR GAS DRAINAGE OF METAL MOLD FOR DIE-CASTING AND METAL MOLD FOR DIE-CASTING

(75) Inventors: Yasuyuki Mizukusa, Fuchu (JP); Mitsuaki Kitamura, Fuchu (JP)

(73) Assignee: Ryobi Ltd., Fuchu-shi (JP)

( * ) Notice: Subject to any disclaimer, the term of this patent is extended or adjusted under 35 U.S.C. 154(b) by 305 days.

(21) Appl. No.: 12/973,103

(22) Filed: Dec. 20, 2010

(65) Prior Publication Data

US 2011/0088866 A1 Apr. 21, 2011

(51) Int. Cl.
*B22D 17/00* (2006.01)
*B22C 23/00* (2006.01)
*B29C 33/46* (2006.01)

(52) U.S. Cl.
USPC ..... 164/305; 164/410; 249/141

(58) Field of Classification Search
USPC ..... 164/305, 410, 61, 372, 253, 113; 425/420, 812; 249/141
See application file for complete search history.

(56) References Cited

U.S. PATENT DOCUMENTS

| | | | | |
|---|---|---|---|---|
| 5,004,038 | A * | 4/1991 | Kuriyama | 164/305 |
| 5,219,409 | A * | 6/1993 | Campbell et al. | 164/457 |
| 6,923,243 | B2 * | 8/2005 | Uebayashi et al. | 164/305 |

FOREIGN PATENT DOCUMENTS

| | | | |
|---|---|---|---|
| JP | 5-015961 | A | 1/1993 |
| JP | 2002-239704 | A | 8/2002 |
| JP | 2010-069511 | A | 4/2010 |
| JP | 2010-075975 | A | 4/2010 |
| JP | 2010-105025 | A | 5/2010 |

OTHER PUBLICATIONS

"Development of the Internal Vacuum Valve for Die Casting: New valve builds on improvements to Ryobi's proprietary vacuum valve," Casting (Sokeizai), Jan. 2010, vol. 51 No. 1, p. 18.

* cited by examiner

*Primary Examiner* — Kevin P Kerns
*Assistant Examiner* — Steven Ha
(74) *Attorney, Agent, or Firm* — Westerman, Hattori, Daniels & Adrian, LLP

(57) ABSTRACT

A valve device has a main body in which an exhaust hole configuring a part of the gas drainage path is formed; a valve element capable of opening and closing the exhaust hole; a cylinder housing a piston coupled to the valve element; and an electromagnetic selector valve for selectively switching a supply route of a driving fluid supplied from a fluid supply source of a die-casting machine to the cylinder either to a front chamber of the cylinder or to a rear chamber of the cylinder. The main body includes a front face configuring a part of a parting face and a fitting portion that tightly adheres to a wall face of a housing hole. The electromagnetic selector valve is positioned on a rear side of the main body, and positioned inwardly of a contour line of the man body formed by the fitting portion.

7 Claims, 7 Drawing Sheets

VALVE DEVICE FOR GAS DRAINAGE OF METAL MOLD FOR DIE-CASTING AND METAL MOLD FOR DIE-CASTING

BACKGROUND OF THE INVENTION

1. Field of the Invention

The present invention relates to a valve device for gas drainage used for a metal mold for die-casting, and relates also to a metal mold for die-casting.

2. Description of the Related Art

In a die-casting method, molten metal is injected at high speed into a mold cavity. Therefore, the molten metal may suck up gases such as air inside the cavity. To prevent the sucking up of such gases, there is known a vacuum die-casting method in which the gases inside the cavity are sucked out with a vacuum pump before injecting the molten metal such that the cavity is set to a decompressed state.

In a vacuum die-casting machine employing the vacuum die-casting method, a valve device for selectively communicating and blocking a gas drainage path is installed in the middle of the gas drainage path connecting a vacuum pump installed outside the metal mold and the mold cavity. That is, when a valve element of the valve device is opened, the gas drainage path is communicated, the gases inside the cavity are removed by the vacuum pump, the cavity is set in a decompressed state, and when the valve element of the valve device is closed, the gas drainage path is blocked.

Japanese Unexamined Patent Application Publication No. H05-15961 discusses a vacuum die-casting machine equipped with the above-described valve device. This vacuum die-casting machine is of horizontal type, and the valve device is installed from above in a housing dent formed on the upper end of a stationary mold. The valve device is equipped with a cylinder so that the valve element is driven to open and close. A piston is housed in the cylinder, and this piston is coupled to the valve element via a valve stem. The cylinder is partitioned into a front chamber and rear chamber by the piston. An electromagnetic selector valve is provided between a compressor for supplying compressed air and the cylinder, and when the electromagnetic selector valve switches a supply route of the compressed air, the compressed air is supplied either to the front chamber or to the rear chamber of the cylinder. When the compressed air is fed into the front chamber, the valve element moves backward and the gas drainage path is blocked, and when the compressed air is fed to the rear chamber, the valve element moves forward and the gas drainage path is communicated. However, this valve device is installed on the upper end of the stationary mold, and is far away from the cavity. Therefore, a long gas drainage path is formed between the cavity and valve device. If the gas drainage path from the cavity to the valve device is long, then the amount of molten metal flowing in the gas drainage path becomes large, and the amount of molten metal consumed in one shot increases. Further, the efficiency of processing the molten metal that has solidified in the gas drainage path also deteriorates.

SUMMARY OF THE INVENTION

A valve device for gas drainage, in use for a metal mold for die-casting, according to the present invention is a valve device for gas drainage, mounted to the metal mold, capable of selectively communicating and blocking a gas drainage path used for draining gases from a cavity of the mold. The valve device includes: a main body in which an exhaust hole configuring a part of the gas drainage path is formed; a valve element capable of opening and closing the exhaust hole; a cylinder housing a piston coupled to the valve element; and an electromagnetic selector valve for selectively switching a supply route of a driving fluid supplied from a fluid supply source of a die-casting machine to the cylinder either to a front chamber of the cylinder or to a rear chamber of the cylinder, the front chamber and the rear chamber being partitioned by the piston. The main body includes a front face configuring a part of a parting face and a fitting portion that tightly adheres to a wall face of a housing hole, when the valve device is fitted into the housing hole opening to the parting face of the metal mold. The electromagnetic selector valve is positioned on a rear side of the main body, and at the same time, positioned inwardly of a contour line of the man body formed by the fitting portion when the main body is viewed from the front face. When the valve device for gas drainage according to the present invention is fitted into the housing hole of the metal mold, the gas drainage path from the cavity to the valve device can be shortened.

DESCRIPTION OF THE PREFERRED EMBODIMENT

Figure 1:
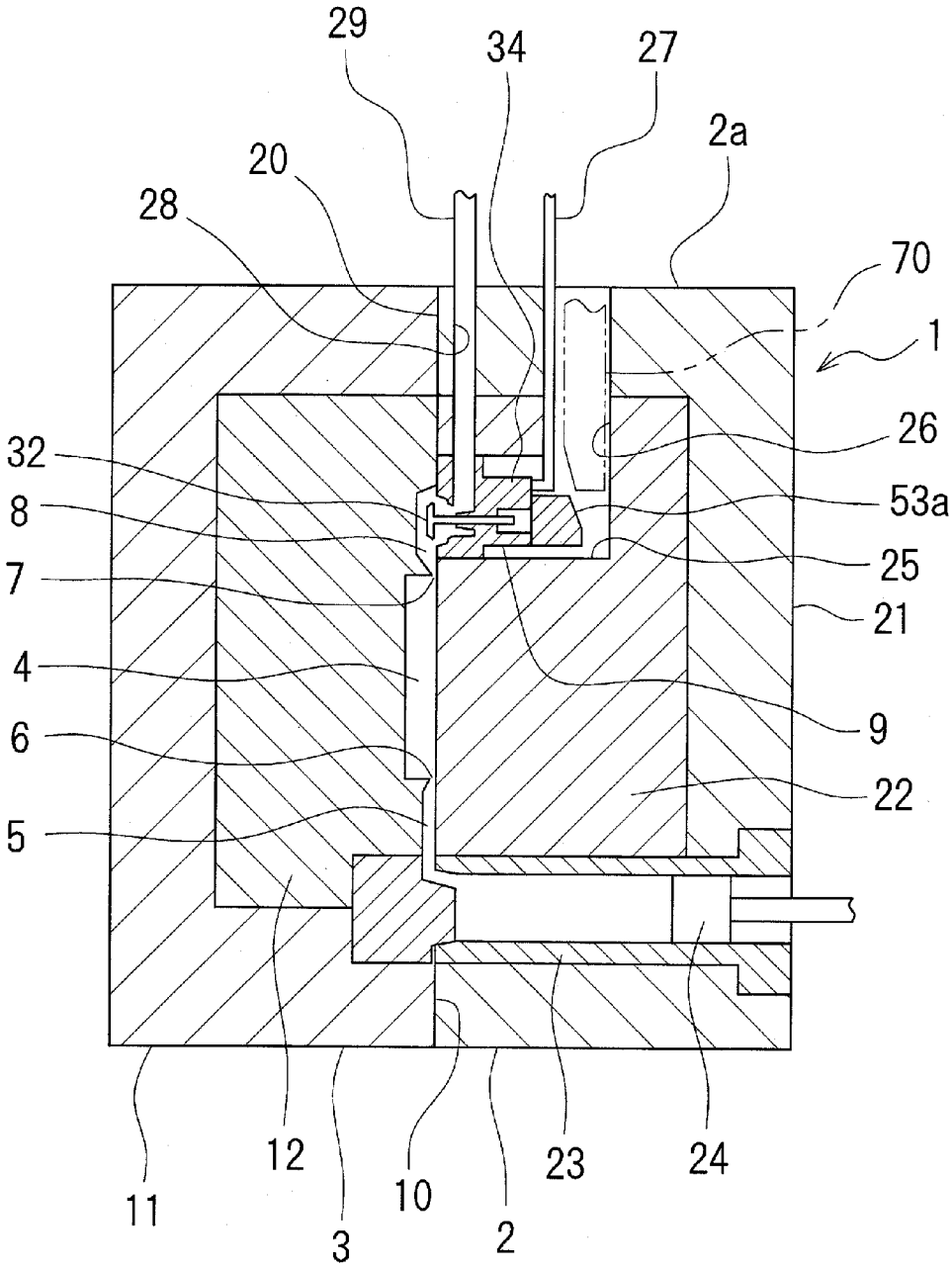
FIG. 1 is a cross-sectional view showing a metal mold for die-casting.

A metal mold 1 of a die-casting machine shown in FIG. 1 is provided with a stationary mold 2 and a movable mold 3. Because this die-casting machine is of horizontal type, the stationary mold 2 and movable mold 3 are installed in such a way that the front faces of both molds 2 and 3 are opposite to each other in the horizontal direction. The metal mold 1 is used preferably in a vacuum die-casting machine employing a vacuum die-casting method.

On the front face of the movable mold 3, there is a parting face 10 that faces the stationary mold 2 and can abut the stationary mold 2. The movable mold 3 is equipped with a movable holder 11 and a movable die 12. In the movable holder 11, a die housing part opening to the front side is formed, and the movable die 12 is housed in this die housing part.

On the front face of the stationary mold 2, there is a parting face 20 that faces the movable mold 3 and can abut the movable mold 3. The stationary mold 2 is equipped with a stationary holder 21 and a stationary die 22. A die housing part opening to the front side is formed in the stationary holder 21, and the stationary die 22 is housed in this die housing part. A cavity 4 is formed between the stationary die 22 and movable die 12.

That is, the movable mold 3 is configured in such a way that it advances and retreats in right and left directions of FIG. 1 that is a horizontal direction. The movable holder 11 and the movable die 12 advance or retreat as one unit. When the mold is clamped, the cavity 4 is formed between the movable die 12 and the stationary die 22 by the abutment between the parting face 10 of the movable mold 3 and the parting face 20 of the stationary mold 2 when the movable mold 3 moves forward to the right side of FIG. 1. Further, when the mold is opened, the movable mold 3 retreats to the left side of FIG. 1 and the parting face 10 of the movable mold 3 moves away from the parting face 20 of the stationary mold 2.

A plurality of extrusion pins (not shown) are installed in the movable mold 3. One end of the plurality of extrusion pins can be protruded toward the front direction from the front face of the movable die 12. The other end of the plurality of extrusion pins is coupled to an extrusion plate (not shown), and by driving this extrusion plate forwardly and backwardly, the plurality of extrusion pins advance and retreat simultaneously. When the cavity 4 is formed by clamping the mold, one end of the extrusion pins flushes with the surface of the movable die 12 that is a wall face of the cavity 4, and when a die-cast product is retrieved from the movable mold 3 by opening the mold, the extrusion pins protrude from the surface of the die of the movable mold 3 to push out the die-cast product to the front side.

In the stationary mold 2, a sleeve 23 and a plunger 24 that can slide within the sleeve 23 are installed. Molten metal such as melted aluminum alloy is supplied within the sleeve 23. This molten metal is fed from within the sleeve 23 to a runner 5 by the plunger 24, and is then fed to the cavity 4 from the runner 5 via a gate 6. An exhaust runner 8 is formed on the upper side of the cavity 4 via the gate 7. This exhaust runner 8 is formed by the formation of a groove in the movable die 12 and the stationary die 22, but the major part of the exhaust runner 8 is formed by the groove on the side of the movable die 12. A sensor (not shown) is installed in the exhaust runner 8. When the molten metal that has flown in to the exhaust runner 8 via the gate 7 reaches a position of the sensor, the sensor detects the molten metal and issues a signal. The exhaust runner 8 configures a part of a gas drainage path for draining (i.e., releasing) gases such as air from cavity 4.

A housing hole 25 is formed in the stationary die 22. The housing hole 25 opens to the parting face 20 of the stationary mold 2. The housing hole 25 communicates with the upper end of the exhaust runner 8. The housing hole 25 extends in the horizontal direction that is a direction away from the movable die 12, and includes an axial line in a direction perpendicular to the parting face 20 of the stationary mold 2.

A through hole 26 is formed from a far side of the housing hole 25 toward the upper side. This through hole 26 is formed from the housing hole 25 to an upper face 2*a* of the stationary mold 2, an air supply pipe 27 for passing compressed air is inserted into the through hole 26, and the compressed air is fed to the air supply pipe 27 from a compressor (not shown) that functions as a fluid supply source. Also, a member shown by an alternate long and two short dashes line in FIG. 1 is a tool 70 for removing the valve device 9, and the tool 70 can be inserted into the through hole 26 from the top.

Further, an exhaust through hole 28 is formed from a relatively front side of the housing hole 25 toward the upper side. The exhaust through hole 28 is formed from the housing hole 25 to the upper face 2*a* of the stationary mold 2, and an exhaust pipe 29 is inserted into the exhaust through hole 28. The exhaust pipe 29 is connected to a vacuum pump (not shown). The exhaust pipe 29 configures a part of the gas drainage path. Further, two through holes for cooling (not shown) are formed from the relatively front side of the housing hole 25 toward the upper side. These two through holes for cooling are formed from the housing hole 25 to the upper face 2*a* of the stationary mold 2, and cooling pipes (not shown) are respectively inserted into the two through holes for cooling to allow the flow of cooling water. This cooling water is coolant for cooling the metal mold 1.

The valve device 9 for selectively communicating and blocking the gas drainage path is fitted into the housing hole 25. The valve device 9 is inserted from an opening at the front side of the housing hole 25. That is, the valve device 9 is inserted into the housing hole 25 from the left side of FIG. 1 toward the right side. Thus, the front face of the valve device 9 flushes with the parting face 20 of the stationary mold 2.

As shown in FIG. 2 to FIG. 7, the valve device 9 includes: a main body 31 on which the exhaust hole 30 is formed; a valve element 32 capable of opening and closing of the exhaust hole 30 of the main body 31; a cylinder 33 for driving the valve element 32; an electromagnetic selector valve 34 for switching the supply route of the compressed air to the cylinder 33; and two extrusion pins 35 capable of advancing and retreating in the back and forth directions.

Figure 2:
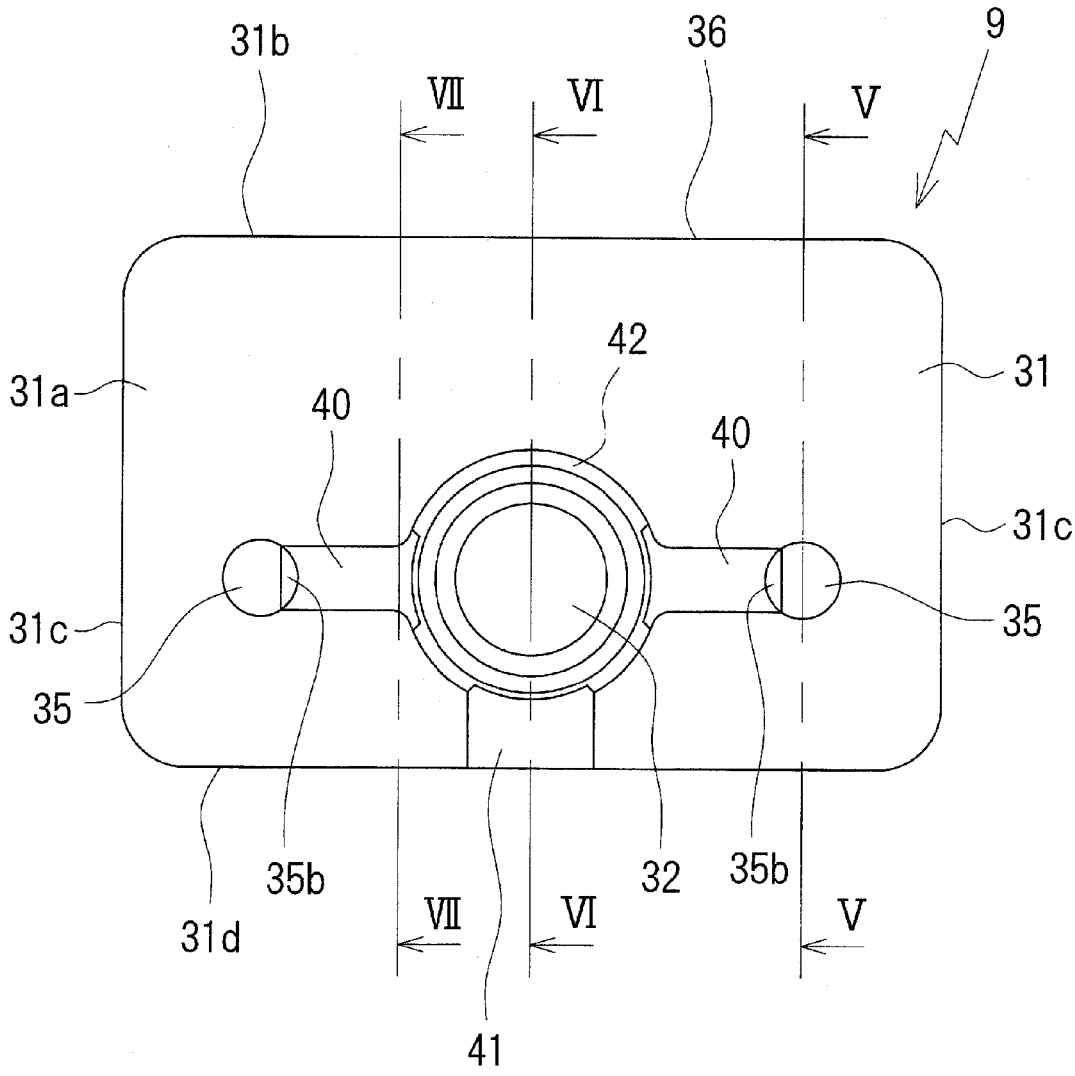
FIG. 2 is a front view showing a valve device.
Figure 5:
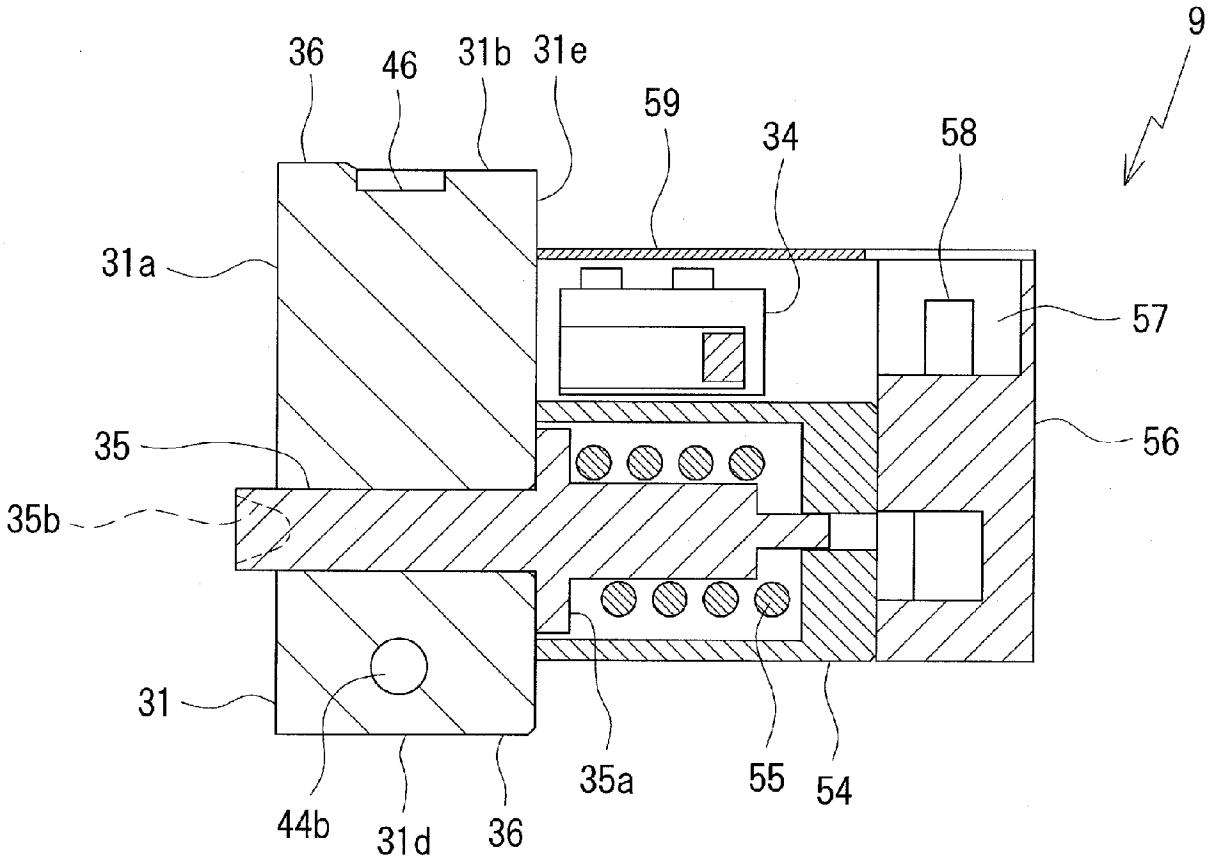
FIG. 5 is a cross-sectional view along a line V-V in FIG. 2 or FIG. 4.

The main body 31, which is a block, configures a part at the front side of the valve device 9. The main body 31 is formed from the same material as that of the stationary mold 2. Examples of this material include special steel such as carbon steel and hot work tool steel. The main body 31, which is a rectangular solid, is so configured that the size in the horizontal direction is longer than that in the vertical direction, as shown in FIG. 2, and the size in the front-back direction is shorter than that in the vertical direction, as shown in FIG. 5. The front face 31*a* of the main body 31 is approximately rectangular. The front face 31*a* of the main body 31 is the front face of the valve device 9. Therefore, when the valve device 9 is fitted into the housing hole 25, the main body 31 closes the opening at the front side of the housing hole 25, and the front face 31*a* of the main body 31 flushes with the parting face 20 of the stationary mold 2 to configure a part of the parting face 20. Further, the front face 31*a* of the main body 31 is perpendicular to the axial line of the housing hole 25.

The main body 31 also includes a fitting portion 36 that tightly adheres to the wall face of the housing hole 25. The fitting portions 36 are formed on an upper face 31*b*, side faces 31*c* on the left and right, and a bottom face 31*d* of the main body 31. The length of the front-back direction of the fitting portion 36 is the same on the upper face 31*b* of the main body 31 and on the side faces 31*c* on the left and right of the main body 31, and the length of the front-back direction of the fitting portion 36 is shorter than the total length of the front-back direction of the main body 31. The fitting portion 36 on the bottom face 31*d* of the main body 31 configures the entire bottom face 31*d*. Therefore, the length of the front-back direction of the fitting portion 36 on the bottom face 31*d* of the main body 31 is the same as the total length of the front-back direction of the main body 31.

The fitting portion 36 extends from the periphery of the front face 31*a* of the main body 31 toward the rear side. Therefore, the fitting portion 36 on the upper face 31*b* of the main body 31 and the fitting portions 36 on the two side faces 31*c* are positioned at the front portion of the main body 31. A rear side portion on the upper face 31*b* of the main body 31 is lower by one step than a front side portion, and the rear side portion on the two side faces 31*c* of the main body 31 is positioned by one step inwardly of the front side portion. Therefore, the rear side portion on the upper face 31*b* of the main body 31 and the rear side portion on the two side faces 31*c* of the main body 31 do not tightly adhere to the wall face of the housing hole 25, and a gap exists between these two rear sides and the wall face. The entire bottom face 31*d* of the main body 31 tightly adheres to the wall face of the housing hole 25. Therefore, the front side portion on the upper face

31*b* of the main body 31, the front side portion on the two side faces 31*c* of the main body 31, and the entire bottom face 31*d* of the main body 31 configure the fitting portion 36. As shown in FIG. 2, when the valve device 9 is viewed from the front side, a contour line of the main body 31 is formed by the fitting portion 36.

As shown in FIG. 2, a T-shaped groove is formed on the front face 31*a* of the main body 31. That is, a horizontal groove 40 extending in the horizontal direction, and a vertical groove 41 extending toward the lower side from an approximate center of the horizontal groove 40 are formed on the front face 31*a* of the main body 31. A circular dent 42 is formed at an intersection of the horizontal groove 40 and the vertical groove 41. An exhaust hole 30 is formed in the main body 31. The exhaust hole 30 is configured by: a horizontal hole 30*a* opening to the circular dent 42 and extending from the dent 42 to the rear side to pass through the main body 31; and a vertical hole 30*b* extending from a midpoint of the horizontal hole 30*a* toward the upper side and opening to the upper face 31*b* of the main body 31. Moreover, a valve seat 43 is formed around the opening at the front side of the exhaust hole 30. The above-described vertical groove 41 is in continuation with the exhaust runner 8, and the above-described exhaust pipe 29 is connected to the vertical hole 3 Ob . Therefore, the vertical groove 41, the horizontal groove 40, the circular dent 42, and the exhaust hole 30 configure a part of the gas drainage path.

Figure 4:
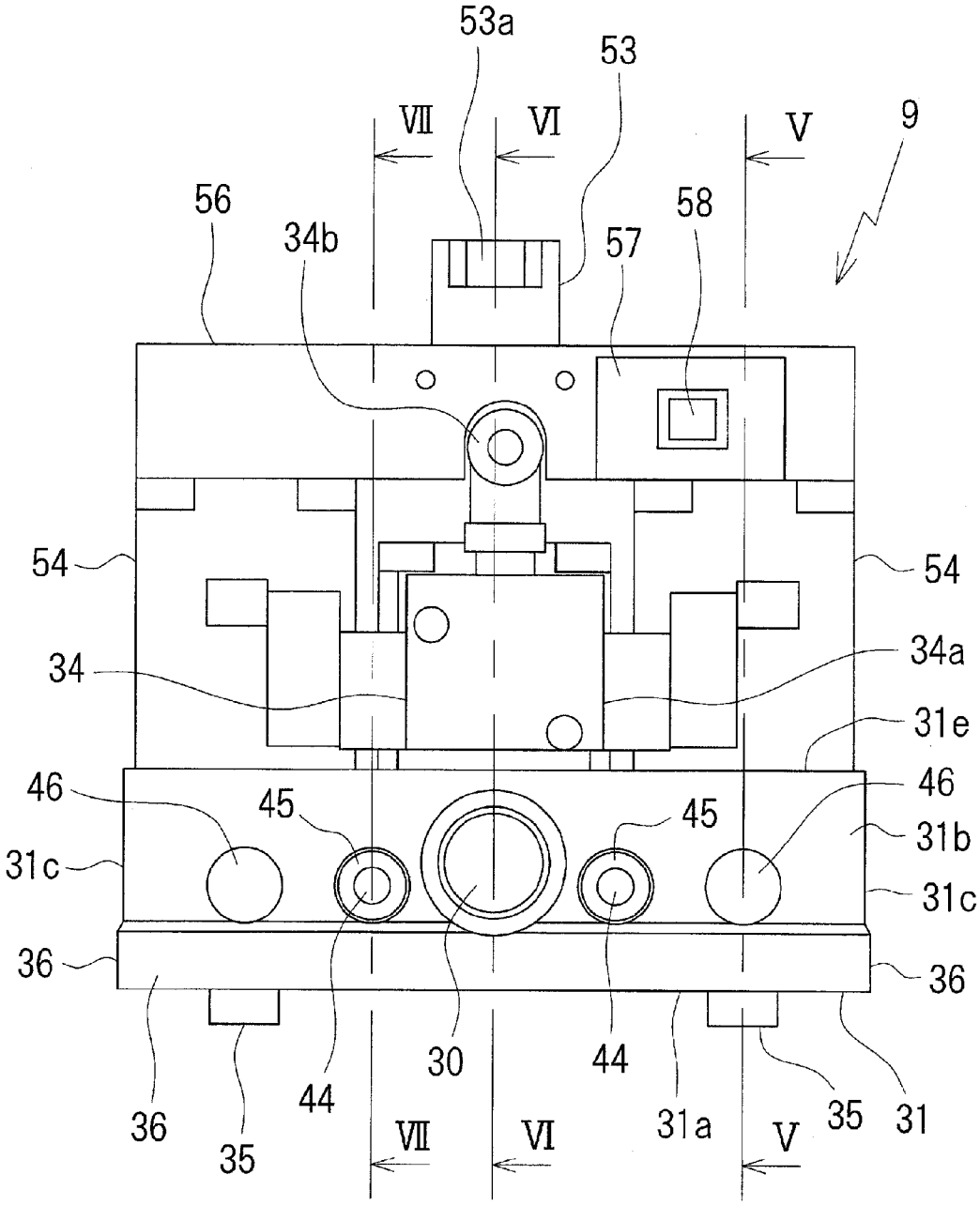
FIG. 4 is a plane view showing a state where a cover of the valve device is removed.
Figure 7:
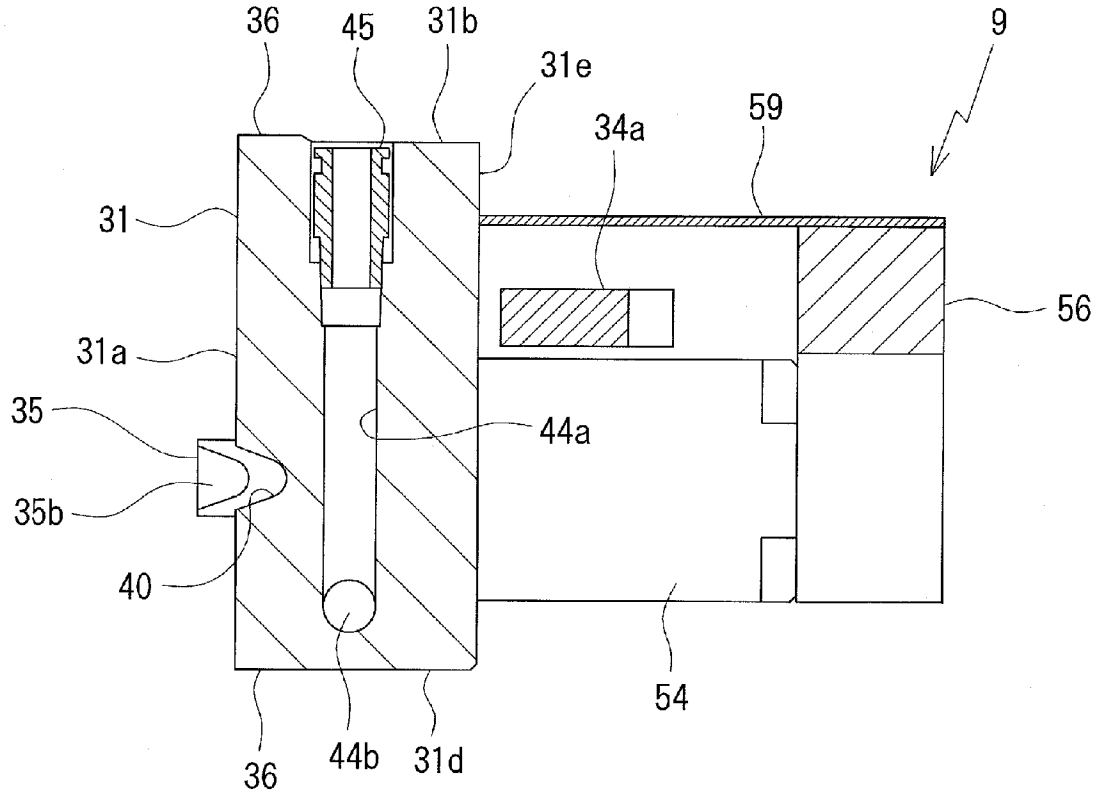
FIG. 7 is a cross-sectional view along a line VII-VII in FIG. 2 or FIG. 4.

A cooling hole 44 for allowing the flow of cooling water is formed in the main body 31. As shown in FIG. 4 and FIG. 7, the cooling hole 44 is configured by: two vertical holes 44*a*; and a horizontal hole 44*b* connecting the lower ends of both the vertical holes 44*a*. The two vertical holes 44*a* are positioned on both sides of the exhaust hole 30, and both of the two vertical holes 44*a* open to the upper face 31*b* of the main body 31. Each of the connectors 45 is inserted into the upper portion of the vertical hole 44*a*, and the cooling pipe is connected to this connector 45.

As shown in FIG. 4, two dents 46 for positioning the valve device 9 are formed on the upper face 31*b* of the main body 31. The two dents 46 are symmetrical with respect to an upper end opening of the exhaust hole 30. When a screw rod (not shown) is inserted into the screw hole (not shown) provided on the stationary mold 2 and then the distal end of the screw rod is engaged with the dent 46, the valve device 9 can be positioned with respect to the housing hole 25.

A tube 50 is mounted to the rear end opening of the horizontal hole 30*b* of the exhaust hole 30 from the rear side, and a valve stem 51 extending from the valve element 32 toward the read side is inserted into the tube 50. When the valve element 32 moves forward to stay away from the valve seat 43, the exhaust hole 30 opens, and as a result, the exhaust runner 8 and exhaust hole 30 are communicated. When the valve element 32 moves backward to contact the valve seat 43, the exhaust hole 30 closes, and as a result, the exhaust runner 8 and exhaust hole 30 are blocked.

A piston 52 is installed at the rear end of the valve stem 51. The piston 52 is housed in the cylinder 33, and partitions the space of the cylinder 33 into a front chamber 33*a* and a rear chamber 33*b*. The cylinder 33 is fixed on a rear face 31*e* of the main body 31 and extends toward the rear side, while the axial line of the cylinder 33 is parallel to the axial line of the housing hole 25.

Figure 6:
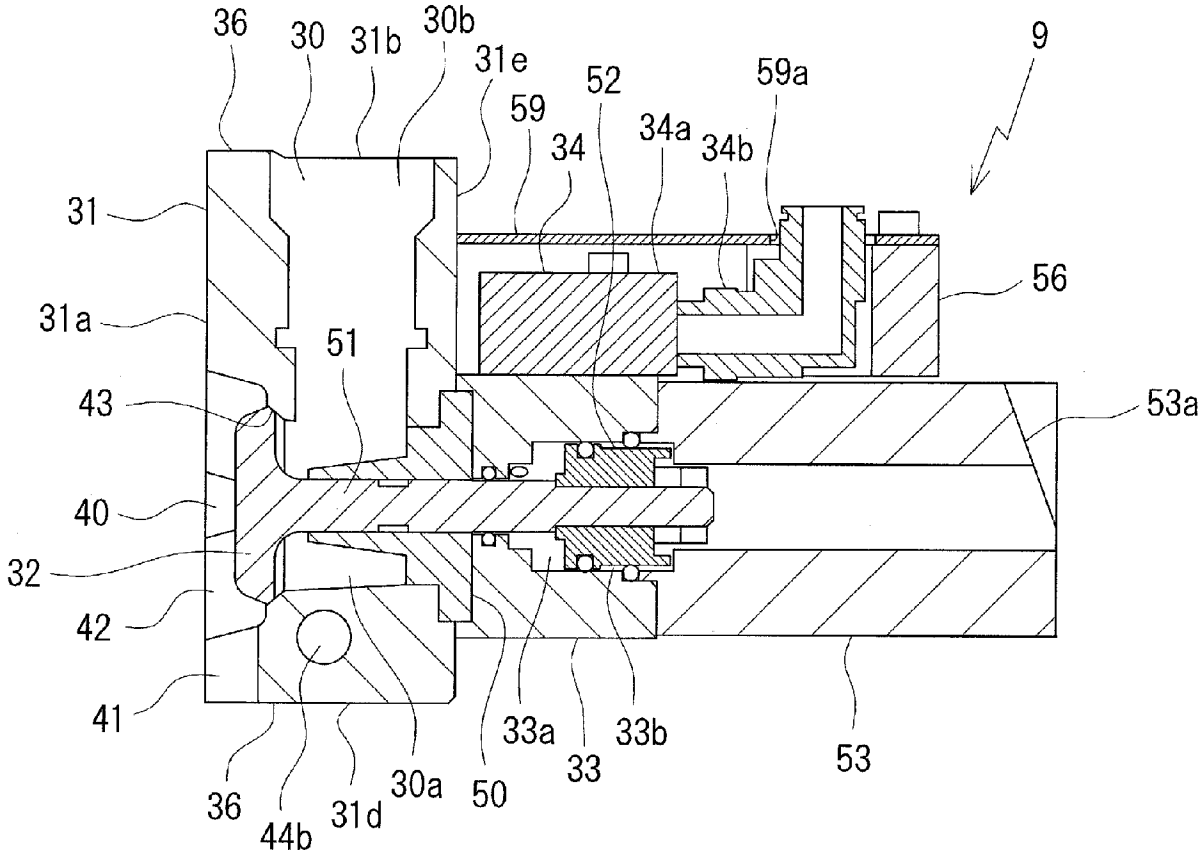
FIG. 6 is a cross-sectional view along a line VI-VI in FIG. 2 or FIG. 4.

An electromagnetic selector valve 34 is mounted to the upper face of the cylinder 33. As shown in FIG. 6, the electromagnetic selector valve 34 is disposed at a position backwardly away from the main body 31, and a gap is formed between the main body 31 and the electromagnetic selector valve 34. The electromagnetic selector valve 34 includes a selector valve main body 34*a* and a connecting tube 34*b* for supplying compressed air to the selector valve main body 34*a*. The selector valve main body 34*a* is mounted to the upper face of the cylinder 33 by screws, and switches the supply route of the compressed air between the front chamber 33*a* and rear chamber 33*b* of the cylinder 33 based on an electrical signal fed from outside the valve device 9. The compressed air functions as a driving fluid for driving the piston 52 forwardly and backwardly. When the compressed air is supplied to the front chamber 33*a* of the cylinder 33, the piston 52 moves back and the valve element 32 closes, and when the compressed air is supplied to the rear chamber 33*b* of the cylinder 33, the piston 52 moves forward and the valve element 32 opens. Further, the connecting tube 34*b* is connected to the rear face of the selector valve main body 34*a*, extends toward the rear side from the rear face, and then extends further toward the upper side, and the air supply pipe 27 is connected to the upper end opening that opens on the upper side.

A block 53 for removal is mounted to the rear face of the cylinder 33, and extends toward the rear side. As shown in FIG. 4 and FIG. 6, the rear end of the block 53 for removal is positioned at the backmost location of the valve device 9, and on the rear end, a slanting face 53*a* that tilts forward as it moves toward the upper side is formed. As shown by an alternate long and two short dashes line in FIG. 1, when the tool 70 for removal is inserted into the metal mold 1 from above and the slanting face 53*a* is pushed downwardly, the valve device 9 can be removed from the housing hole 25 toward the front side.

Pin housing cases 54 are provided on both left and right sides of the cylinder 33. As shown in FIG. 5, the two pin housing cases 54 are mounted to the rear face 31*e* of the main body 31. In the two pin housing cases 54, the rear part of the extrusion pin 35 and a spring 55 for pushing the extrusion pins 35 toward the front side are housed, respectively. The spring 55 is a coil spring that pushes a flange 35*a* of the extrusion pin 35 toward the front side. When the flange 35*a* of the extrusion pin 35 touches the rear face 31*e* of the main body 31, the extrusion pin 35 cannot move further ahead toward the front side. When the front part of the extrusion pin 35 passes through the main body 31 toward the front side, and the flange 35*a* of the extrusion pin 35 touches the rear face 31*e* of the main body 31, the front end of the extrusion pin 35 protrudes toward the front side from the front face 31*a* of the main body 31.

As shown in FIG. 2, the two extrusion pins 35 are disposed symmetrically with respect to the valve element 32. More particularly, the front end of each of the two extrusion pins 35 is located on the both ends of the horizontal groove 40 of the main body 31. A notch 35*b* is formed on the front end of the extrusion pins 35. During clamping of the mold, if the extrusion pin 35*b* is pushed toward the rear side by the movable mold 3, then the notch 35 becomes one unit with the horizontal groove 40, and the molten metal passes through the horizontal groove 40 to reach the notch 35*b*. Therefore, the solidified molten metal can be pushed out toward the front side at the front end of the extrusion pin 35 when opening the mold.

Further, a rear block 56 is mounted to the rear face of each of the two pin housing cases 54. The rear blocks 56 are shaped in a gate as viewed from the rear side, span across the top of the block 53 for removal that is installed in the center, and link the rear faces of the both pin housing cases 54. A dent 57 for connector is formed on the upper face of the rear block 56, and a connector 58 is installed in this dent 57 for connector. An electrical cable for feeding an electrical signal to the electromagnetic selector valve 34 is connected to connector 58 from above.

Figure 3:
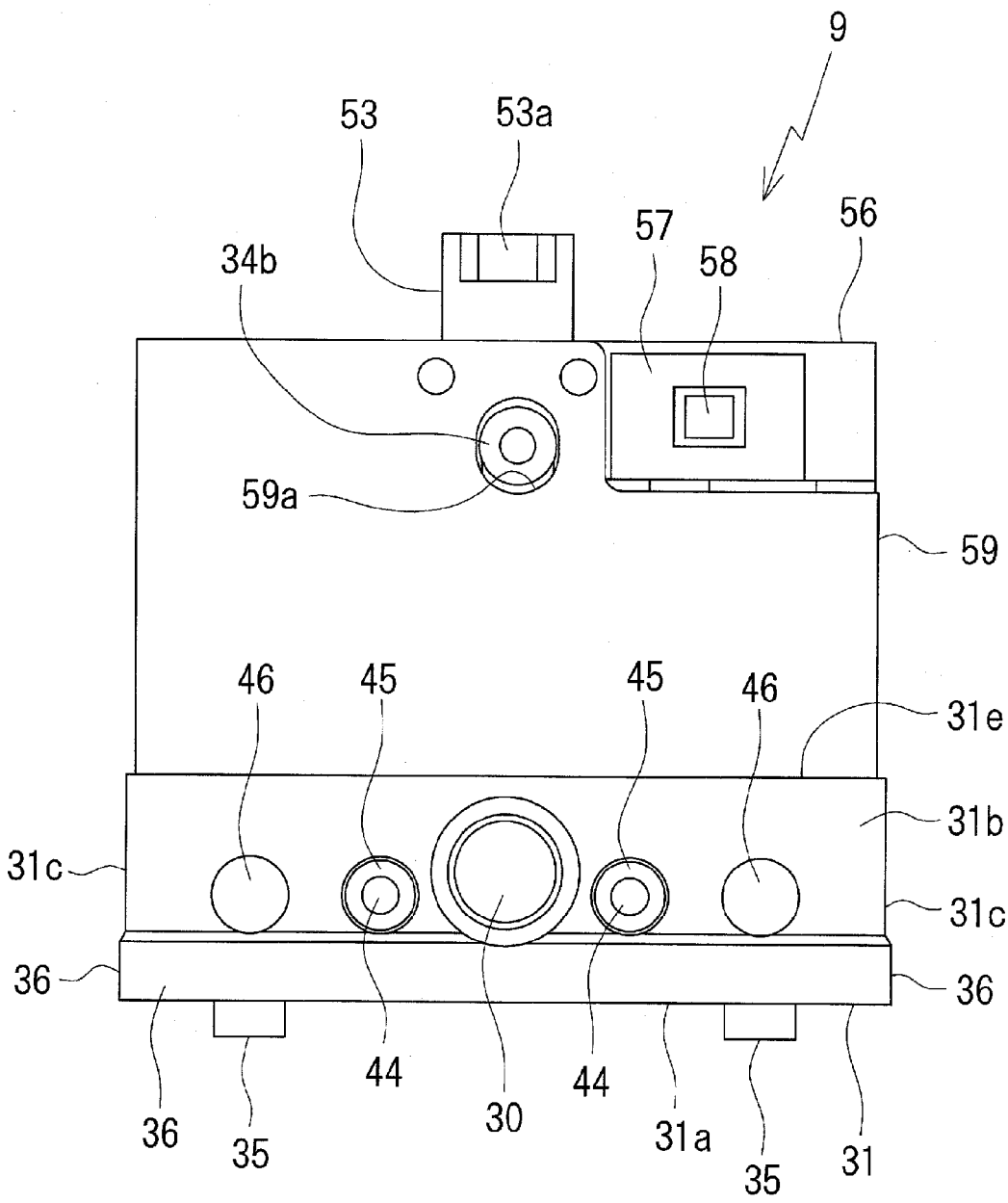
FIG. 3 is a plane view showing the valve device.

Then, a cover 59 is mounted to the upper face of the rear block 56 by screws. As shown in FIG. 3, the cover 59 covers from above members positioned further behind the main body 31. Both left and right ends of the cover 59 extend to be bent downwardly, and reach near the upper face of the left and right pin housing cases 54. Therefore, a primary object of the cover 59 is to cover the electromagnetic selector valve 34. The electromagnetic selector valve 34 is positioned between the main body 31 and rear block 56, and at the same time, covered by the cover 59. However, a hole 59*a* is formed on the rear part on the upper face of the cover 59, and from this hole 59*a*, the upper end opening of the connecting pipe 34*b* of the electromagnetic selector valve 34 protrudes slightly toward the upper side. Moreover, apart of the cover 59 is notched, and from this partially notched part, the connector 58 is exposed toward the upper side.

As shown in FIG. 3, the cover 59 is positioned inwardly of the left and right side faces of the main body 31. In the valve device 9, the outermost location in the left and right directions is the side faces 31*c* of the main body 31, and out of the side faces 31*c*, the fitting portion 36 that is the front side portion is the outermost. As shown in FIG. 6, the upper face of the cover 59 is lower than the upper face 31*b* of the main body 31, and the upper end opening of the connecting pipe 34*b* also is lower than the upper face 31*b* of the main body 31. Therefore, in the valve device 9, the upper face 31*b* of the main body 31 is at the highest location, and out of the upper face 31*b* of the main body 31, the fitting portion 36 that is the front side portion is the highest. Moreover, in the valve device 9, the bottom face 31*d* of the main body 31 is at the lowest location. That is, when the valve device 9 is viewed from the front side, as shown in FIG. 2, the contour line of the main body 31 is the largest and is positioned on the outside, and all other members such as the electromagnetic selector valve 34, the cylinder 33, and the pin housing cases 54 are positioned inwardly of the contour line of the main body 31.

Therefore, the valve device 9 can be easily fitted into the housing hole 25 of the stationary mold 2. By fitting the valve device 9 into the housing hole 25 of the stationary mold 2, the distance from the cavity 4 to the valve device 9 is reduced, and the length of the exhaust runner 8 is shortened. Therefore, the amount of molten metal flowing in the exhaust runner 8 can be reduced, and the amount of molten metal consumed in one shot can also be reduced as compared to the amount conventionally consumed. The efficiency of processing the molten metal that has solidified in the exhaust runner 8 also improves. Further, the deformation of the metal mold 1 can also be prevented.

When the valve device 9 is installed in the stationary mold 2, only the fitting portion 36 of the main body 31 tightly adheres to the wall face of the housing hole 25, and the electromagnetic selector valve 34 is away from the wall face of the housing hole 25. Thus, it becomes difficult for the heat to be transferred from the stationary mold 2 to the electromagnetic selector valve 34, and the electromagnetic selector valve 34 can be protected from a high temperature. Moreover, because the connecting pipe 34*b* of the electromagnetic selector valve 34 is connected to the rear face of the selector valve main body 34*a*, the height of the connecting pipe 34*b* can be lowered as compared to, for example, a case where the connecting pipe 34*b* is connected to the upper face of the selector valve main body 34*a*. Further, because the cooling water is flowing in the cooling hole 44 of the main body 31, it becomes difficult for the main body 31 to heat up, and thus, the transfer of the heat from the main body 31 to the electromagnetic selector valve 34 can also be prevented. Moreover, the main body 31 and the stationary mold 2 are made from the same material, and therefore, the strength of the main body 31 is high and the main body 31 can be prevented from being deformed due to heat.

When performing maintenance of the valve device 9, the valve device 9 can be pushed out to the front side by using the tool 70 for removal, and thus, it can be removed from the parting face 20 of the stationary mold 2. Because only the main body 31 contacts the wall face of the housing hole 25 and the other members such as the electromagnetic selector valve 34 and the cylinder 33 do not contact the wall face of the housing hole 25, the valve device 9 can be easily removed from the housing hole 25. Particularly, because the fitting portion 36 is positioned on the front part of the main body 31, the valve device 9 can be easily mounted or removed from the housing hole 25. Moreover, because the fitting portions 36 on the upper face 31*b* and on the left and right side faces 31*c* of the main body 31 are shorter than the length in the front-back direction of the main body 31, the valve device 9 can be easily mounted to or removed from the housing hole 25. The electromagnetic selector valve 34 is covered with the cover 59, and therefore, damages to the electromagnetic selector valve 34 can be prevented when fitting the valve device 9 into the housing hole 25 and also when removing the valve device 9 from the housing hole 25.

In a state where the valve device 9 is fitted into the housing hole 25, the exhaust pipe 29, the cooling pipe, the air supply pipe 27, and the electrical cable are connected to the valve device 9, or reversely, removed from the valve device 9. At this time, because all the members such as the exhaust pipe 29 are operated from above the stationary mold 2, a task of connecting the members to and removing them from the valve device 9 can be performed easily.

Next, a die-casting method that employs the above-described metal mold 1 is explained. First, the movable mold 3 is moved in a direction closer to the stationary mold 2, that is, it is moved toward the right side of FIG. 1, and the mold is clamped when the parting face 10 of the movable mold 3 is abutted to the parting face 20 of the stationary mold 2. Molten metal is injected into a sleeve 23 when the valve element 32 of the valve device 9 is opened. At the beginning, the plunger 24 is moved at low speed in the left direction of FIG. 1. At this time, the vacuum pump sucks up the gases within cavity 4 via the exhaust runner 8 and exhaust pipe 29. Thereafter, the plunger 24 is moved at high speed and the molten metal is filled inside the cavity 4. When the molten metal touches a sensor after flowing in the exhaust runner 8 through the gate, the sensor detects the molten metal and issues a signal, and then based on this signal, the electromagnetic selector valve 34 switches the supply route of the compressed air to the front chamber 33*a* of the cylinder 33. When the compressed air is supplied to the front chamber 33*a*, the valve element 32 retreats and the exhaust hole 30 is blocked.

Then, after the molten metal in the cavity 4 solidifies upon cooling, the movable mold 3 is gradually kept away from the stationary mold 2 by moving the movable mold 3 toward the left side of FIG. 1. At this point, the two extrusion pins 35 of the valve device 9 move forward after being pushed by the spring 55. When the two extrusion pins 35 move forward, the molten metal that has solidified within the groove of the main body 31 is pushed out toward the front side. Thus, the solidified molten metal, together with the movable mold 3, moves away from the stationary mold 2. Thereafter, a die-cast product is pushed out by the extrusion pins 35 of the movable mold 3, and is separated from the movable mold 3.

It is noted that although the main body 31 and the cylinder 33 are formed separately, these can also be formed as one unit. Moreover, on the upper face 31*b* and the left and right side faces 31*c* of the main body 31, only the front side portions are considered as the fitting portion 36, however, the entire upper face 31*b* and the entire left and right side faces 31*c* may also be considered as the fitting portion 36. Further, the housing hole 25 may be a through hole extending to the rear face of the stationary mold 2, and a hydraulic cylinder for pushing out the valve device 9 from the rear side to the front side may also be mounted to the housing hole 25. Moreover, instead of using the tool 70 for removal and the hydraulic cylinder, a magnet may be mounted on the front face 31*a* of the main body 31 and the valve device 9 may be pulled out to the front side by magnetic force, for example. Further, the cover 59 for covering the electromagnetic selector valve 34 has been provided, but this cover 59 may be omitted.

Also, the valve device 9 can not only be applied to the metal mold 1 of the vacuum die-casting machine, but also to a metal mold of a die-casting machine of a type in which gases within the cavity are not sucked out by a vacuum pump. In such a method, the gases within the cavity are not forcibly exhausted by the vacuum pump, but the gases are exhausted as a result of the cavity being simply communicated to ambient air outside the metal mold.

The gas drainage path and the housing hole may be formed in the movable mold, and the valve device for gas drainage may be arranged in the movable mold.

What is claimed is:

1. A valve device for gas drainage, mounted to a metal mold for die-casting, capable of selectively communicating and blocking a gas drainage path used for draining gases from a cavity of the metal mold, the device comprising:

a main body in which an exhaust hole configuring a part of the gas drainage path is formed;

a valve element capable of opening and closing the exhaust hole;

a cylinder housing a piston coupled to the valve element; and an electromagnetic selector valve for selectively switching a supply route of a driving fluid supplied from a fluid supply source of a die-casting machine to the cylinder either to a front chamber of the cylinder or to a rear chamber of the cylinder, the front chamber and the rear chamber being partitioned by the piston, wherein the main body includes a front face and a fitting portion, the front face configuring a part of a parting face of the metal mold, and the fitting portion that adheres to a wall face of a housing hole of the metal mold when the valve device is fitted into the housing hole, wherein the housing hole has a periphery surrounding the housing hole, the periphery being entirely formed on the parting face of the metal mold, and the electromagnetic selector valve is positioned on a rear side of the main body, and at the same time, positioned inwardly of a contour line of the main body formed by the fitting portion when the main body is viewed from the front face, wherein when the main body is viewed from the front face, the contour line of the main body is positioned outermost such that any parts other than the main body are not viewed from the front face, wherein when the valve device is inserted inside the housing hole, only the fitting portion of the main body is adhered to the wall face of the housing hole, and any parts other than the fitting portion are away from the wall face of the housing hole, wherein in the main body, a cooling hole through which coolant passes is formed, the cooling hole being different from the gas drainage path.

2. The valve device for gas drainage according to claim 1, wherein the fitting portion extends from the periphery of the front face toward the rear side.

3. The valve device for gas drainage according to claim 2, wherein the fitting portion includes a portion shorter than a length of a front-back direction of the main body.

4. The valve device for gas drainage according to claim 1, wherein the electromagnetic selector valve includes a selector valve main body mounted to the cylinder and a connecting tube for supplying driving fluid to the selector valve main body, and the connecting tube is connected to a rear face of the selector valve main body.

5. The valve device for gas drainage according to claim 1, wherein the main body is made from the same material as that of the metal mold.

6. A metal mold for die-casting comprising a stationary mold for forming a cavity and a movable mold for forming a cavity, the stationary mold and the movable mold including parting faces facing each other, wherein a gas drainage path for draining gases from the cavity and a housing hole opening to the parting face are formed in one of the stationary mold and the movable mold, in order to selectively communicate and block the gas drainage path, a valve device for gas drainage according to claim 1 is fitted into the housing hole, and wherein the housing hole communicates with an exhaust through hole and a cooling through Hole.

7. A metal mold for die-casting comprising a stationary mold for forming a cavity and a movable mold for forming a cavity, the stationary mold and the movable mold including parting faces facing each other, wherein the metal mold further comprises the valve device for gas drainage according to claim 1.

* * * * *